US006178935B1

(12) United States Patent
Diehl et al.

(10) Patent No.: US 6,178,935 B1
(45) Date of Patent: Jan. 30, 2001

(54) VALVE CONTROL DEVICE FOR AN INTERNAL COMBUSTION ENGINE

(75) Inventors: Udo Diehl, Stuttgart; Karsten Mischker, Leonberg; Rainer Walter, Pleidelsheim; Stefan Franzl, Grosshelfendorf; Volker Beuche, Stuttgart; Stefan Reimer, Markgroeningen; Ulrich Kappenstein, Knittlingen, all of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/485,540

(22) PCT Filed: Feb. 16, 1999

(86) PCT No.: PCT/DE99/00423

§ 371 Date: May 8, 2000

§ 102(e) Date: May 8, 2000

(87) PCT Pub. No.: WO99/66177

PCT Pub. Date: Dec. 23, 1999

(30) Foreign Application Priority Data

Jun. 12, 1998 (DE) ..... 198 26 046

(51) Int. Cl.[7] ..... F01L 9/02
(52) U.S. Cl. ..... 123/90.12; 123/188.9
(58) Field of Search ..... 123/90.12, 90.13, 123/90.19, 90.24, 90.33, 188.9

(56) References Cited

U.S. PATENT DOCUMENTS 4,175,534 * 11/1979 Jordan ..... 123/198 F
4,821,689 * 4/1989 Tittizer et al. ..... 123/90.12

FOREIGN PATENT DOCUMENTS 39 35 218 * 4/1991 (DE) .
2 277 777 * 11/1994 (GB) .
98 07966 * 2/1998 (WO) .

* cited by examiner

*Primary Examiner*—Weilun Lo
(74) *Attorney, Agent, or Firm*—Ronald E. Greigg; Edwin E. Greigg

(57) ABSTRACT

A valve control device for an internal combustion engine having a gas exchange valve for controlling an inlet and/or outlet cross section in the combustion chamber of the engine. The valve control device has an axially movable gas exchange valve member whose valve member shaft is coupled to a piston rod to a differential piston that can be hydraulically actuated. The differential piston is embodied as two piston parts, wherein the two piston parts are disposed in relation to one another in such a way that they are operatively connected to each other in the axial direction and can execute a radial relative movement in relation to each other.

14 Claims, 1 Drawing Sheet

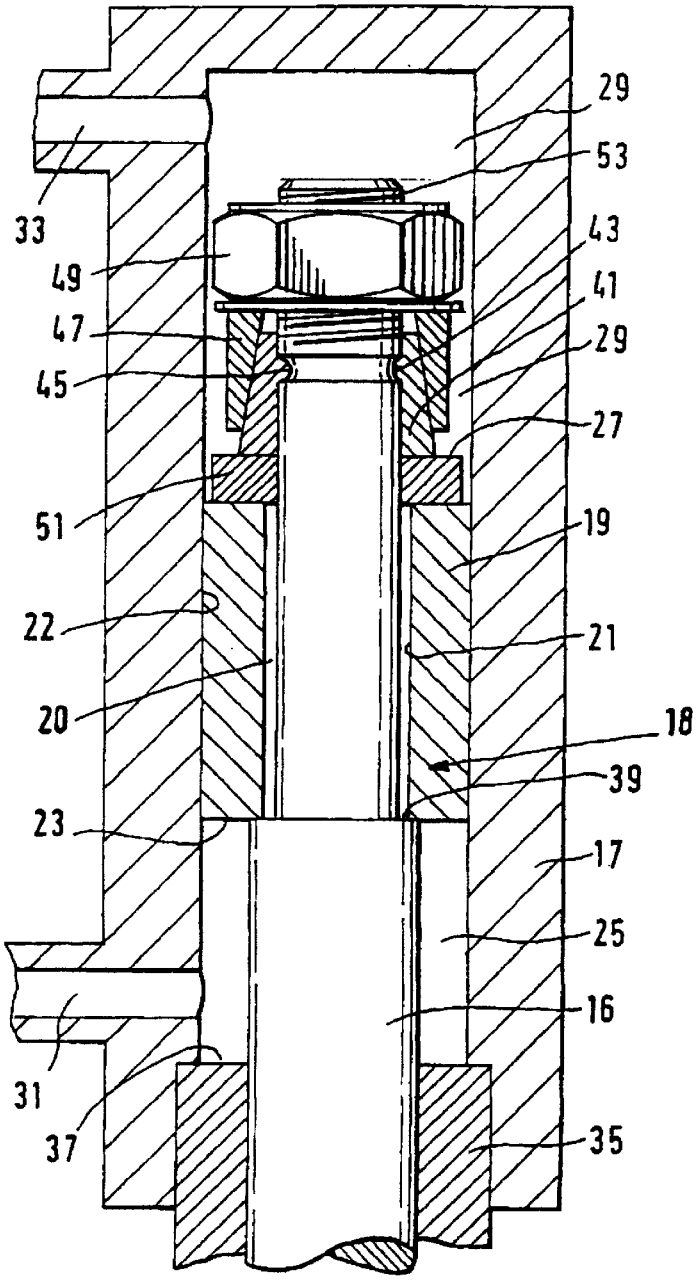
29
53
33
43
49
41
47
29
45
27
51
19
22
21
20
18
39
23
17
25
16
31
37
35
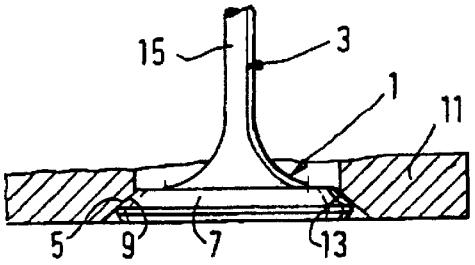
15
3
1
11
5
9
7
13

VALVE CONTROL DEVICE FOR AN INTERNAL COMBUSTION ENGINE

PRIOR ART

The invention is based on a valve control device for an internal combustion engine. In a valve control device of this kind, which has been disclosed by DE 195 11 320 A1, a piston-shaped valve member of a gas exchange valve controls the opening and closing of an inlet and outlet cross section on the combustion chamber of the engine to be fed. The gas exchange valve, which is embodied as a disk valve, has an axially movable valve member whose valve member shaft is coupled by way of a piston rod to an adjusting piston (differential piston) that can be hydraulically actuated, by which the individual gas exchange valve can be directly actuated independently of the other gas exchange valves. The hydraulic adjusting piston in the known valve control device is thereby disposed directly on the valve member shaft or the piston rod of the gas exchange valve and thereby constitutes a part of the gas exchange valve member itself. With a lower annular end face, the adjusting piston defines a first hydraulic working chamber and with its upper piston end face, defines a second hydraulic working chamber, and these working chambers can be filled with a highly pressurized pressure fluid and emptied by way of corresponding pressure fluid lines. The hydraulic working pressure in the lower working chamber acts on the adjusting piston in the closing direction of the gas exchange valve and the upper working chamber acts on the adjusting piston in the opening direction of the valve member of the gas exchange valve. It is then possible, through the alternating filling of the working chambers with high pressure, to hydraulically actuate the adjusting piston and to thus move the valve member of the gas exchange valve rigidly connected to it in the opening or closing direction.

The known valve control device, however, has the disadvantage that a static redundancy occurs on the adjusting piston, which is caused by a double centering of the adjusting piston. Since the hydraulic adjusting piston is guided directly on its outer circumference surface and is also guided on its inner surface by way of the piston rod firmly connected to the adjusting piston, along a second guide surface of the valve member, which even with extremely small tolerance deviations can cause the hydraulic adjusting piston to stick and can result in a jamming of the gas exchange valve.

Valve control devices have also been disclosed in which the hydraulic adjusting piston is fastened to the valve member shaft of the gas exchange valve by means of a screw thread. This has the further disadvantage that the transmission of force from the hydraulic adjusting piston to the valve member shaft occurs by way of the screw thread, which results in a high dynamic alternating tension/pressure stress in a zone with a concentration of stress, which can cause fatigue fractures there.

ADVANTAGES OF THE INVENTION

The valve control device has the advantage over the prior art that the hydraulic differential piston actuating the gas exchange valve has a radial play between its two guide surfaces, or in relation to the guide surface of the gas exchange valve.

This is achieved in a structurally advantageous manner by virtue of the fact that the piston of a hydraulic valve actuation device, which is preferably embodied as a differential piston, has two parts, wherein the two piston parts are guided so that they can slide axially, are operatively connected to each other, and have a radial play in relation to each other. Consequently, the two piston parts can execute a relative motion in the radial direction in relation to each other, which in the event of tolerance deviations, reliably prevents a jamming of the differential piston and thus reduces the manufacturing costs with regard to tolerance sensitivity. In order to nevertheless assure a reliable sealing of the two hydraulic working chambers defined by the differential piston, the two-part differential piston is embodied so that a first piston part slides in a sealed fashion with a large diameter on its radial outer circumference surface against a cylinder guide surface, wherein it has a radial play in relation to the piston rod of the gas exchange valve that passes through it axially. The second, smaller diameter piston part is guided in a sealed fashion with its radial inner wall surface against the piston rod and has a radial play in relation to the cylinder guide wall. The two piston parts can now move radially in relation to each other during operation, wherein the axial piston end faces that are oriented toward each other rest against each other in a sealed fashion. Alternatively, however, it is also possible to provide an axial sealing element, e.g. a sealing disk, between the end faces of the piston parts of the differential piston. Furthermore, it is possible to embody one of the two piston end faces as ball-shaped in order to produce a reliable seal between the end faces.

The two piston parts are also operatively connected to the piston rod in the axial direction by way of axial stop faces and have a slight axial play that permits a radial compensation movement in relation to each other. The valve member shaft of the gas exchange valve is advantageously embodied as being of one piece with the piston rod of the differential piston and is advantageously guided axially in a guide bush whose end wall surface simultaneously defines a lower hydraulic working chamber. On the one end, the stop face on the piston rod is advantageously embodied as an annular stop face which comes into direct contact with the one end face of the differential piston. The second stop is advantageously constituted by a separate component, which is press-fitted onto the shaft of the piston rod, is embodied as a valve wedge, and can be placed around the piston rod as a result of having a multi-part form.

On its outer circumference, this wedge-shaped component has a conical cross sectional expansion in the direction of the differential piston and a corresponding cone ring is slid axially against this expansion. The clamping force directed radially inward is exerted by means of a clamping nut that is screwed onto the piston rod and thereby clamps the cone ring through the radial clamping of the wedge-shaped stop components. A lower end face of the wedge-shaped stop components thus constitutes a stop face, which cooperates with an upper annular end face of the differential piston. In order to define the position of the wedge-shaped stop components on the shaft of the piston rod, it is also advantageous to provide the valve wedges with ribs that protrude radially inward and engage in a corresponding groove on the shaft of the piston rod.

In order to prevent a loss of the clamping force exerted by the clamping nut, and in order to also permit an axial compensation of play, it is also advantageous to provide a spring element between the nut and the cone ring, which spring element is preferably embodied as a spring disk or spring ring and can have a U-shaped contour.

With the above-described disposition and fastening of the upper stop to the piston rod, it is possible to guide the larger diameter differential piston part with radial play in relation to the shaft of the piston rod and in a sealed fashion inside the cylinder housing and to guide the smaller diameter differential piston part with radial play in relation to the cylinder housing wall and in a sealed fashion against the piston rod, wherein the working chambers axially adjoining the differential piston are completely sealed off from one another by the axial seal between the differential piston parts. Consequently, the two piston parts of the differential piston can be axially guided independently of one another against the guide surfaces, with very tight fits or tolerances. As a result, the elastic sealing elements required in known valve control devices are no longer necessary.

Alternatively, it is also possible to replace the piston rod completely by means of the valve member shaft of the gas exchange valve.

Furthermore, the currently separate guidance of the individual piston parts permits high relative speeds of the individual sealing surfaces on these components in relation to one another. Because of the radial play between the piston parts, it is also possible for there still to be a reliable transmission of force in both axial directions even at high temperatures, wherein no dynamic loads are introduced onto the thread of the clamping nut of the upper stop.

It is consequently possible with the valve control device according to the invention to integrate the gas exchange valve member shaft into the actuator of a hydraulic valve actuator and thereby to fasten the valve member shaft directly to the hydraulic differential piston without radial forces or moments being transmitted between these two moving components.

In this connection, the invention is described in conjunction with a valve control device in which both the opening and closing motion of the gas exchange valve member are executed hydraulically; alternatively, however, it is also possible to execute the closing stroke motion of valve member of the gas exchange valve mechanically, e.g. by means of a valve spring.

Furthermore, in the above-described exemplary embodiment, the hydraulic piston is directly connected to a piston rod that is embodied of one piece with the valve member shaft of the gas exchange valve. Alternatively, however, it is also possible to fasten the hydraulic piston to a piston rod which is in turn coupled to the valve member shaft of the gas exchange valve outside the cylinder.

It is also possible to embody the differential piston part which is guided against the piston rod in a sealed fashion as being of one piece with the piston rod or to press-fit this piston part onto the piston rod.

Other advantages and advantageous embodiments of the subject of the invention can be inferred from the following description, the drawings, and the claims.

BRIEF DESCRIPTION OF THE DRAWING

An exemplary embodiment of the valve control device according to the invention for an internal combustion engine is shown in the drawing and will be explained in detail below.

The sole FIGURE shows a longitudinal section through the valve control device as well as the lower end of the gas exchange valve member with the valve disk and the corresponding valve seat on the combustion chamber of the engine to be fed.

DESCRIPTION OF THE EXEMPLARY EMBODIMENT

The valve control device for an internal combustion engine is shown in a simplified sectional representation in the sole FIGURE. The valve control device has a gas exchange valve 1 whose piston-shaped gas exchange valve member 3 can move axially. A valve sealing face 5 on a disk-shaped valve member head 7, cooperates with a stationary valve seat 9 on the housing 11 of the engine in order to control an inlet or outlet cross section 13 of the combustion chamber of the engine. The gas exchange valve member 3 has a valve member shaft 15 which transitions into a piston rod 16 that is of one piece and protrudes into a cylinder housing 17 of a hydraulic adjusting device. The piston rod 16 has a cylindrical, two-part differential piston 18 disposed on it, with a first, larger diameter piston part 19 whose axial through opening wall 21 has a radial play 20 in relation to the piston rod 16. The larger diameter differential piston part 19 is guided with an outer circumference wall surface resting against a guide wall surface 22 in the cylinder housing 17 in a sealed, sliding fashion, and with axial end faces, respectively defines hydraulic working chambers in the cylinder housing 17. A lower end face 23 of the piston part 19 that is close to the combustion chamber defines a lower hydraulic working chamber 25, which can continue into the radial, annular gap 20 via a play between the piston rod 16 and the piston part 19.

A second piston part 51 of the differential piston 18 is embodied with a smaller diameter than the first piston part 19. This piston part 51 is guided in a sealed fashion against the shaft of the piston rod 16 and has a radial play in relation to the guide wall 22 of the cylinder housing 17. The piston parts 19, 51, with their axial end faces oriented toward one another, rest in a sealed fashion against one another, wherein a radial relative movement of the piston parts 19, 51 in relation to one another is possible. With its end face 27 remote from the gas exchange valve 1, the differential piston 18 defines another, upper hydraulic working chamber 29 in the cylinder housing 17.

The working chambers 25 and 27 can be filled with a hydraulic working medium and emptied by way of pressure fluid lines 31, 33, wherein in the exemplary embodiment described above, the openings of the pressure fluid lines can each be opened and closed in a manner that is not shown in detail by means of a respective control valve, preferably a solenoid valve, as a function of a control unit.

At its entry into the cylinder housing 17, the valve member shaft 15 or the piston rod 16 is axially guided in a sealed fashion by means of a guide sleeve 35. The guide sleeve 35, which is inserted in a sealed fashion with its outer circumference into the cylinder housing 17 defines the lower working chamber 25 on its end remote from the differential piston 18 with its upper end wall face 37 protruding into the cylinder housing 17. The upper working chamber 29 is closed on its end remote from the differential piston 18 by means of an end wall of the cylinder housing 17.

On its circumference surface, the piston rod 16 has two stops which can be contacted by the end faces 23, 27 of the differential piston 18 in both axial adjustment directions.

In this connection, a lower shoulder 39 constitutes a first stop face on the piston rod 16, wherein the shoulder 39 is formed by a cross sectional reduction of the shaft of the piston rod 16 in the direction of the end remote from the combustion chamber. However, the larger diameter differential piston part 19 rests with its lower piston end face 23 against this shoulder 39 only when there is no high pressure prevailing in the lower working chamber 25. Otherwise, the high pressure in the lower working chamber 25 holds the piston part 19 in contact with the upper stop so that between the shoulder face 39 on the piston rod 16 and the lower piston end face 23 on the piston part 19, a slight axial play remains, by means of which the pressure fluid can flow into the annular gap 20 and by means of which the piston rod 16 and the differential piston 18 can move axially in relation to each other. This play is necessary in order to prevent a static redundancy of the system since the closing stroke motion of the gas exchange valve member 3 is limited by the centering action during the contact with the valve seat face 9.

On the upper end of the piston rod 16 that is remote from the combustion chamber and protrudes from the differential piston 18, a valve wedge 41 comprising two shells is disposed on the shaft of the piston rod 16. This wedge 41 is embodied as annular and rest with cylindrical inner wall faces flush against the piston rod shaft 16. The outer wall faces of these wedges are embodied conically, wherein the wall thickness of the wedges 41 increases uniformly in the direction toward the differential piston 18. Furthermore, the wedges 41, on their inner wall faces, have an annular rib 43 which protrudes into a corresponding annular groove 45 in the circumference wall of the piston rod 16. This obliquely extending radial outer circumference wall of the wedges 41 has a cone ring 47 slid axially onto the wedges 41 whose inner wall diameter conically decreases in the direction toward the differential piston 18 in a fashion complementary to the cone angle of the wedges 41. The cone ring 47 is pressed axially against the wedges 41 by means of a clamping nut 49, for which purpose the clamping nut 49 is screwed onto a thread 53 provided on the upper end of the piston rod 16.

As a result, the wedges 41 are clamped radially against the shaft of the piston rod 16 so that the transmission of force from the differential piston 18 onto the piston rod 16 and furthermore onto the shaft 15 of the gas exchange valve member 3 takes place by way of the wedges 41 and the thread 53 is not exposed to any changing stresses related to the introduction of force.

Through the alternative interposition of a spring ring, not shown in detail, between the cone ring 47 and the clamping nut 49, settling phenomena of the components can be compensated for and the necessary initial stress in the axial connection can be maintained.

In this connection, the lower annular end face of the wedges 41 oriented toward the differential piston 18 constitute the second stop face on the piston rod 16 in which the second piston part 51 of the differential piston 18 comes into contact.

The seal between the upper working chamber 29 and the lower working chamber 25 thereby takes place by means of the radial inner wall surface of the smaller piston part 51, which is disposed in a sealed fashion against the piston rod 16, the sealed contact between the end faces of the piston parts 51, 19, and the radial outer wall guidance between the larger piston part 19 and the guide wall 22 of the cylinder housing 17.

In order to seal the lower working chamber 25 in relation to the outside, a sealing ring can also be provided between the guide sleeve 35 and the shaft of the piston rod 16 in order to thus permit a play between the piston rod 16 and the guide sleeve 35.

The axial guidance of the piston rod 16 and the differential piston 18 or the valve member shaft 15 is thereby executed merely by means of the circumference surfaces of the piston rod 16 and the differential piston part 19, wherein the two piston parts 51 and 19 of the differential piston 18 can thereby execute a relative motion in the radial direction in relation to one another, which reliably prevents a tilting and jamming of the differential piston 18 in the cylinder housing 17 even in the event of tolerance deviations.

The valve control device according to the invention for an internal combustion engine functions in the following manner. When at rest, i.e. when the valve member 3 is resting against the valve seat 9, the hydraulic pressure in the lower working chamber 25 exceeds the hydraulic working pressure in the upper working chamber 29 so that the differential piston 18 is acted on in the direction of the upper working chamber 29 and thus, the gas exchange valve member 3 is fixed in its closed position. If an opening event of the gas exchange valve 1 should now be produced, the lower working chamber 25 is depressurized (or alternatively brought to the same pressure level) via of the control valve, not shown in detail, and the pressure fluid line 31 and at the same time, the upper working chamber 29 is filled with a highly pressurized pressure fluid by means of the pressure fluid line 33 so that the adjusting force acting on the differential piston 18 in the upper working chamber 29 exceeds the adjusting force acting on the differential piston 18 in the lower working chamber 25 since the total pressure engagement area of the differential piston 18 is greater in the upper working chamber 29 and in the lower working chamber 25. As a result, the high pressure prevailing in the upper working chamber 29 moves the differential piston 18 in the direction of the lower working chamber 25, wherein the gas exchange valve member 3, 15, which is connected to the differential piston 18 by way of the piston rod 16, is moved in the direction of the combustion chamber. As a result, with its valve sealing face 5, the valve member 3 lifts away from the valve seat 9 and clears an inlet or outlet cross section 13 from a supply conduit into the combustion chamber of the engine, which is not shown in detail.

The closing stroke motion of the valve member 3 takes place again by means of a depressurization of the upper working chamber 29 and a pressurization of the lower working chamber 25, as a result of which the differential piston 18 and along with it, the gas exchange valve member 3 are moved in the direction of the upper working chamber 29 again until the valve member 3, with its valve sealing face 5, rests once more in a sealed fashion against the valve seat 9. The reciprocal filling and discharging of the working chambers 25 and 29 takes place by way of solenoid valves in the pressure fluid lines 31, 33 which are controlled as a function of operating parameters of the engine by way of a control unit that is not shown in detail.

The foregoing relates to a preferred exemplary embodiments of the invention, it being understood that other variants and embodiments thereof are possible within the spirit and scope of the invention, the latter being defined by the appended claims.

What is claimed is:

1. A valve control device for an internal combustion engine comprising a gas exchange valve (1) for controlling an inlet and/or outlet cross section (13) on a combustion chamber of the engine, the gas exchange valve has an axially movable gas exchange valve member (3) with a valve member shaft (15) which is coupled to a piston rod (16), the gas exchange valve is embodied as one piece with the gas exchange valve member shaft (15), coupled to a differential piston (18) that is hydraulically actuated in a cylindrical housing (17), the differential piston (18) is embodied as two parts wherein the two differential piston parts are disposed in relation to one another in such a way that the two differential piston parts are operatively connected to each other in an axial direction and can execute a radial relative movement in relation to each other.

2. The valve control device according to claim 1, in which said differential piston (18) includes a larger diameter piston part (19), with a radial outer circumference surface that constitutes a first guide surface of the differential piston (18), said differential piston (18) is guided so that it can slide in a sealed fashion against a guide wall (22) of the cylinder housing (17), and that another, smaller diameter piston part (51), with a radial inner wall surface, constitutes a second guide surface of the differential piston (18), which is guided in a sealed fashion against the piston rod (16), wherein the two larger and smaller piston parts (19, 51) can execute a radial relative motion in relation to each other.

3. The valve control device according to claim 2, in which the larger and smaller piston parts (19, 51), with their end faces oriented toward each other, rest against each other in a sealed fashion.

4. The valve control device according to claim 2, in which the larger diameter piston part (19) has a radial play (20) in relation to the piston rod (16) that passes through the larger diameter piston part and the smaller diameter piston part (51) has a radial play in relation to the guide wall (22).

5. The valve control device according to claim 1, in which the differential piston (18) defines two hydraulic working chambers in said cylinder housing (17), each of which can be filled with a pressure fluid and emptied by way of separate pressure fluid lines.

6. The valve control device according to claim 5, in which a lower end face (23) of the larger diameter differential piston part (19), which is close to the combustion chamber, defines a lower working chamber (25) whose hydraulic internal pressure acts on the differential piston (18) in the closing direction of the gas exchange valve member (3).

7. The valve control device according to claim 5, in which an upper end face (27) of the differential piston (18), which is remote from the combustion chamber, defines an upper working chamber (29) whose hydraulic internal pressure acts on the differential piston (18) in the opening direction of the gas exchange valve member (3).

8. The valve control device according to claim 2, in which a shoulder (39) is provided on the piston rod (16), said shoulder (39) cooperates with a lower end face (23) of the larger diameter differential piston part (19) disposed close to the combustion chamber.

9. The valve control device according to claim 2, in which on an end of said piston rod that is remote from the combustion chamber and which protrudes from the differential piston (18), the piston rod (16) has a stop (41) with a stop face which cooperates with an upper end face (27) of the differential piston (18) remote from the combustion chamber, wherein the stop (41) is provided on a component that is press-fitted onto the piston rod (16).

10. The valve control device according to claim 9, in which the component which constitutes the stop is composed of at least one wedge (41), which at least partially encompasses the piston rod (16) and whose inner wall surface that is directed radially inward rests against the piston shaft (16) and whose outer wall surface that is directed radially outward extends conically in such a way that a wall diameter of the wedge (41) increases in a direction toward the larger differential piston part (19).

11. The valve control device according to claim 10, in which two shell-shaped wedges (41) are provided which, on their outer circumference wall, are radially encompassed by a cone ring (47), an internal cross-section of the cone ring decreases conically in a direction of the larger differential piston part (19) in a fashion complementary to a cone angle of the wedges (41) and which is axially clamped against the wedges (41) by means of a clamping nut (49) that is screw threaded onto an end of the piston shaft (16).

12. The valve control device according to claim 10, in which ribs (43) protruding radially inward on the inner wall surfaces of the wedges (41) engage in corresponding grooves (45) in the piston shaft (16).

13. The valve control device according to claim 10, in which the stop face is formed on the lower end face of the wedges (41) oriented toward the larger diameter differential piston part (19).

14. The valve control device according to claim 6, in which the lower working chamber (25) disposed close to the combustion chamber, on an end remote from the differential piston (18), is defined by a guide sleeve (35) and the piston rod (16) protrudes outward through said guide sleeve.

* * * * *